US011508270B2

(12) United States Patent
Jauck et al.

(10) Patent No.: US 11,508,270 B2
(45) Date of Patent: Nov. 22, 2022

(54) DISPLAY DEVICE WITH ENERGY-EFFICIENT SCREEN

(71) Applicant: SES-IMAGOTAG GMBH, Graz (AT)

(72) Inventors: Philipp Jauck, Graz (AT); Johannes Samhaber, Graz (AT)

(73) Assignee: SES-IMAGOTAG GmbH, Fernitz-Mellach (AT)

( * ) Notice: Subject to any disclaimer, the term of this patent is extended or adjusted under 35 U.S.C. 154(b) by 352 days.

(21) Appl. No.: 16/756,979

(22) PCT Filed: Oct. 18, 2017

(86) PCT No.: PCT/EP2017/076560

§ 371 (c)(1),
(2) Date: Apr. 17, 2020

(87) PCT Pub. No.: WO2019/076447

PCT Pub. Date: Apr. 25, 2019

(65) Prior Publication Data

US 2021/0319728 A1 Oct. 14, 2021

(51) Int. Cl.
*G09F 13/22* (2006.01)
*G09F 3/20* (2006.01)

(52) U.S. Cl.
CPC ..... *G09F 13/22* (2013.01); *G09F 3/208* (2013.01); *G09F 2013/222* (2013.01)

(58) Field of Classification Search
CPC ..... G09F 13/22; G09F 3/208; G09F 2013/222
See application file for complete search history.

(56) References Cited

U.S. PATENT DOCUMENTS 10,073,211 B1 * 9/2018 Almanza-Workman ..... G02B 6/005
2004/0156418 A1 * 8/2004 Debord ..... G01K 3/04 374/103
2010/0188422 A1 * 7/2010 Shingai ..... G06F 3/016 345/647
2015/0179139 A1 * 6/2015 Watanabe ..... G09G 3/36 345/592
2015/0279248 A1 * 10/2015 Kim ..... G09F 3/204 40/5
2016/0004891 A1 * 1/2016 Moon ..... G09F 3/208 340/10.51
2016/0104397 A1 * 4/2016 Kim ..... G09F 3/208 40/5

* cited by examiner

*Primary Examiner* — Gary C Hoge
(74) *Attorney, Agent, or Firm* — Dennemeyer & Associates, LLC

(57) ABSTRACT

An electronic price and/or product display device (2), which comprises a reflective screen (21) for displaying information, and a signalling device (28) for signalling an internal state or a state change of the display device (2) by superimposing said state or state change in a visually perceptible manner directly in the viewing direction of the screen.

17 Claims, 5 Drawing Sheets

DISPLAY DEVICE WITH ENERGY-EFFICIENT SCREEN

CROSS-REFERENCE TO RELATED APPLICATIONS

This is a 35 U.S.C. 371 National Stage patent Application of International Application No. PCT/EP2017/076560, filed Oct. 18, 2017, which is hereby incorporated by reference in its entirety.

TECHNICAL FIELD

The invention relates to an electronic price and/or product display device for displaying information in an energy-efficient manner.

BACKGROUND

A known (price and/or product) display device, also known as an electronic price display, referred to in the technical jargon as an "Electronic Shelf Label", or ESL, comprises a reflective screen and electronics for controlling the screen, as well as a battery for energy supply. The screen displays static information regarding prices and/or product-relevant information about a product.

Since such a type of screen generally is a reflective, i.e. passive, non-light-emitting screen, the information to be displayed with it can only be clearly displayed with sufficient contrast when sufficient illumination is provided by external light sources, such as the artificial light in the retail spaces of a supermarket. The artificial light then illuminates the screen from the front and is reflected back at the viewer. The use of extremely energy-efficient screens and the operation of the electronics in a highly energy-efficient manner results in a considerable battery life of several years.

The problem with such a display device, however, is that the screen lacks any potential to attract a heightened level of attention from a viewer, for example one giving the display a fleeting glance.

Thus, the object of the invention is to provide an improved display device in which the aforementioned disadvantages are eliminated.

DESCRIPTION OF THE INVENTION

This object is solved by a display device according to claim 1. The subject matter of the invention therefore is an electronic price and/or product display device (2), which comprises a reflective screen (21) for displaying information, and a signalling device (28) for signalling an internal state or an internal state change of the display device by superimposing a signal indicating said state or state change in a visually perceptible manner directly in the viewing direction of the screen.

This object is further solved by a use according to claim 18. The subject matter of the invention therefore also is a use of the display device according to the invention as part of a path-signage system for indicating a path or an emergency exit signage system for indicating a path to an emergency exit.

Such a reflective screen—also referred to in the technical jargon as an electronic paper display, EPD for short—is realised with the help of "electronic paper", also called "e-paper" or "e-ink". These terms essentially represent the principle of an electrophoretic display, in which, for example, positively charged white particles and negatively charged black particles are contained in a transparent, viscous polymer. By briefly applying a voltage to electrodes, between which the medium consisting of particles and polymer is arranged, the black particles are placed in front of the white particles, or vice versa. This arrangement then remains in place for a relatively long time (e.g. a few weeks) without any further energy supply. If the display is segmented accordingly, items such as letters, numbers or images can be displayed with a relatively high resolution to display said information. However, such a reflective screen also can be realised with the help of other technologies, which are known under the terms "electrowetting" or "MEMS", for example. The screen can be designed for black-and-white reproductions, for grayscale reproductions, or for black-and-white-red or black-white-yellow reproductions, for example. Future developments that enable full colour or multi-colour reproduction shall also be included.

Such a screen generally is a reflective, i.e. passive, non-light-emitting screen in which the—relatively static—reproduction of information is based on light generated by an external (artificial or natural) light source reaching the screen and being reflected from there to the viewer. A conventional screen therefore does not have its own illuminating means.

In the display device according to the invention, an additional light signal is used for signalling. This light signal can be present with constant light intensity. However, a light signal differing from a static, e.g. white, light also can be used. Such a dynamic light signal may be provided, for example, by a pulsating light signal, which swells and fades in its brightness, or a flashing light signal. In all of these variants, which attract more attention from the viewer and which can also be combined with each other, the light signal may be provided by white light, but preferably by light in a different colour, such as red, green or blue, orange or violet, etc., because such colours are associated with increased attention from the viewer.

However, the pulsating of the light also can be used to save energy and/or adjust the brightness, wherein the frequency of the pulsation is selected in such a way that the human eye cannot perceive the pulsating of the light. This means that a change in brightness over a certain period of time can be realized even with a flashing light signal.

As explained in more detail below, a state or a state change may be present or develop in the display device in a variety of ways. In order to make these states or state changes usable for signalling, the signalling device is functionally and/or structurally divided into a light signal-emitting device, which generates the visually perceptible light signal, and a light signal control device coupled or interacting with the former and controlling the same, which controls the emitting of the light signal in dependence on said states or state changes.

As previously mentioned, the light signal-emitting device is designed to physically generate the light signal according to control specifications, such as control parameters or control signals or data, from the light signal control device. It therefore has at least one light source and correspondingly designed light-guiding means to emit the light signal at the appropriate position. The specification that the emitting of the light signal is superimposed upon the displayed information directly in the viewing direction of the screen in a visually perceptible manner is meant to show that the light signal is not emitted adjacent to the screen. Rather, it takes place exactly in front of the screen as seen in the viewing direction of the screen. The light signal-emitting device is, for example, arranged at least partially in front of that portion of the screen, which serves to display said information and is designed to be transparent at least in that portion, such that not only the light signal is visually perceptible, but also the information displayed by means of the screen.

Furthermore, the light signal control device is designed for generating the control specifications for the light signal-emitting device depending on the states or state changes. Such states or state changes are the result of various internal data processing processes, while excluding the processing of external environmental parameters such as ambient light intensity or ambient motion detection, etc.

For this purpose, the light signal control device may, for example, be formed by the electronics of the display device or by parts of the same, which, for example, make it possible to communicate with an external base station or are responsible for controlling the screen. Said electronics now also handle additional activities relating to the light signal control and have immediate access to the states or state changes occurring during the processing of commands or parameters, etc., in the electronics of the display device.

However, the light signal control device may also be designed as a stand-alone, separate electronic circuit in addition to the electronics controlling the communication and/or the screen. In this case, it is coupled with the other electronic components of the display device via data signal lines, such as an interface, and the incidence of states or the development of state changes is communicated to the light signal control device by these other electronic components. However, the manner of realising said device can also be selected such that the light signal control device actively queries the incidence of states or the development of state changes from the other electronic components.

In this context, the measures according to the invention are associated with the advantage that the display device originally devised to indicate static information now, by means of the additional light signal, attracts the attention of customers passing by a shelf in a store, for example. The customer passing by the shelf usually lets his gaze wander across the shelf or the products because he is searching for a particular product. In this search, the product-specific information displayed on a conventional shelf label usually has little to no relevance. In fact, the customer sometimes does not perceive the conventional shelf label at all when searching for a specific product. However, the display device according to the invention, by means of its light signal, attracts the attention of the viewer, who now focuses his gaze on the display device. Since the light signal is not sent from any position or location on the housing adjacent to the screen of the display device, but is directly superimposed in the viewing direction of the screen, the information shown there, such as prices and product specification, also is visually highlighted. In particular, this ensures that the customer not only perceives the display device as such with increased attention, but also focuses on the product information which is displayed by means of the screen, views said information and therefore perceives it cognitively.

However, the display device according to the invention also supports the operating personnel of a supermarket, e.g., in which such display devices are mounted on the shelves as price displays, for example.

Conventional electronic display devices normally are controlled centrally by means of radio-based communication and the various product-specific information is communicated to the individual display devices such that it can be displayed by means of the screen. In the event that problems arise in the operation of such conventional display devices or if, for whatever reason, the conventional display devices are not positioned at their intended shelf positions, the manual search for them has proven to be very difficult and, more importantly, very time-consuming. This is due to the fact that the personnel must read the information displayed on each screen during the search and check whether it matches the shelf space where the display device is located.

The electronic display device according to the invention can, via the signalling device, in particular by emitting the light signal with predefined parameters, visually draw attention to the presence of a problem requiring manual interaction by the operating personnel. Such a light signal-emitting display device may be removed from the relevant shelf by the operating personnel and forwarded for maintenance purposes. Furthermore, the operating personnel can trigger actions in the affected display device to fix the problem on site by interacting with the display device via a radio interface on an appropriately designed service apparatus. The detection of, as well as the search for, display devices that are in a faulty state or are in the wrong place is made considerably easier by the light signal.

Further, particularly advantageous embodiments and further developments of the invention follow from the dependent claims as well as the following description.

The display device comprises one or multiple electronic assemblies or components. These can be realized by means of a strictly hardware solution, an ASIC (Application Specific Integrated Circuit) or a microcontroller on which a software is executed, equipped with corresponding memory modules. The power supply can be executed by means of a battery or a rechargeable battery of the display device. However, the power supply can also be executed via external cables by means of contacts of the display device, wherein these contacts make contact with corresponding contacts on a shelf or more generally a holder for the display device, in order to provide the device with electrical power from an external supply. Communication with a base station can also be executed either radio-based, light-based or wired. Radio-based communication uses radio signals, light-based communication uses light signals, and cable-linked communication uses signals carried in lines.

It may be advantageous in a display device according to the invention if the signalling device is designed for overlaying only a portion of the information displayed by means of the screen with said light signal. With this development, individual areas of the screen can be highlighted, or the signal effect of the light signal can be limited to individual areas of the screen.

It may be advantageous in the display device according to the invention if the signalling device is designed for overlaying the information reproduced by means of the screen with different light signals in specific zones. With this development, various independent signals can be realized for different zones of the screen. For example, one half of the screen can emit a green flashing light signal, while the other half of the screen emits a red flashing light signal. Furthermore, a light signal of a certain colour can be set to alternately appear in two different zones of the screen, for example. If, for example, strips are defined as zones, light signals running from strip to strip can be generated, wherein only one strip emits the relevant light signal at any time, but switches over to the adjacent strip after a certain period of time has elapsed. The different light signals basically can have different colours and show independent temporal behaviour.

It may be advantageous in the display device according to the invention if the signalling device is designed for completely overlaying the information reproduced by means of the screen with said light signal, in particular overlaying the entire display area of the screen. With this development, the signal effect of the light signal can be expanded to the entire screen, such that a light signal of maximum expansion and light intensity, and having the corresponding signal effect, is generated.

In the display device according to the invention, a lamp can be provided, for example, for generating the signal effect of the light signal, which lamp illuminates the screen from the front. It has proven to be particularly advantageous that the signalling device comprises a light guide, which is attached or oriented with respect to the screen such that its predominant light dispersion direction extends parallel to the viewing area of the screen. When light is injected into the light guide, this light is largely reflected at its edges or refracted back into the light guide. Nevertheless, a certain amount of light emerges from the edge of the light guide, illuminates the screen directly from the front, i.e. in the viewing direction of the screen, is reflected back by the screen and is emitted through the light guide towards the viewer. Therefore, the viewer, for example the customer in a supermarket, from a distance first predominantly notices the light signal of the electronic price display, which draws his attention to the respective price display. Only upon getting closer to the price display and examining the same more closely, does the customer perceive the cognitive content of the screen intended for him, namely the information concerning products and prices. However, this information is embedded in the respective light signal. If, for example, the light signal is a green, constantly illuminated light, the areas surrounding the black characters (as well as the characters themselves), which represent the information, also appear immersed in green light. If, for example, the light signal is a green flashing light, the areas surrounding the characters (as well as the characters themselves) alternately appear according to their original black-and-white presentation or immersed in green light.

The light guide can be a plate arranged in front of the viewing area of the screen. Preferably, however, it is a film applied to the viewing area of the screen. The viewing area of the screen can then also be curved, and the film can adapt to the curvature. In a display device according to the invention, however, the light guide may also form a component of the screen, preferably covering the external viewing area of the screen or be integrated into it, or form said external viewing area. This makes it possible to realise particularly compact screens having a signalling function, produce them cost-effectively and also completely integrate the signalling device into the screen. Thus, the screen can be installed compactly in the housing of the display device.

In the display device according to the invention, the signalling device comprises one or more light sources, in particular LED or OLED, particularly preferably RGB LED, whereby the light signal is generated. The realisation with the help of a so-called RGB LED has proven to be particularly advantageous, because they make it possible to generate light signals of various colours with the lowest possible energy consumption and in the simplest way. The respective generated coloured light signals can represent or encode different states of the display device. Herein, LED is short for Light Emitting Diode, OLED for Organic LED and RGB for Red, Green and Blue.

In order to ensure an actual focus of the viewer, even at a fleeting glance, on the viewing area of the screen, it has proven to be particularly advantageous if the light source is housed inside the housing of the display device, wherein the light generated with it is preferably or substantially parallel to the viewing area of the screen, or is emitted or directed in a direction toward the viewing area. This avoids emitting the light signal at a location other than the viewing area of the screen, and the viewing area inevitably becomes the focus of a viewer's attention due to the signal effect of the light signal.

In order to optimize the light dispersion as well as the light output of the light source for signalling, it is advantageous if the light source is optically coupled with the light guide for the purpose of injecting the light produced by the light source. The coupling can, for example, be done from the side, from above or from below or at an angle. Optical coupling means can also be used, which optimise the injecting of the light. You can bundle the light generated by the light source and/or direct its dispersion into the light guide. This can also be realised by a curvature of the edge of the light guide toward the light emission direction of the light source. Therein, the injection into the light guide can be executed such that it is focused on a small area, or covering a strip or a wide swath of a larger, extended area. This ensures that the predominant portion of the light emitted by the LED, e.g., is emitted into the light guide and is available in the same to achieve the light signal overlaying the information.

The generation of the light signal takes place internally in the display device according to the invention. Therein, various external as well as internal circumstances can serve as triggers for the light signal. In a display device according to the invention, it therefore has proven to be particularly advantageous that the signalling device is designed for detecting a state or a state change as a result of a radio-based, light-based or line-based communication with an external device. For example, the internal operating state serving as a trigger for the generation of the light signal can be the updating of the information which is displayed by means of the screen, or the establishing of a connection, or the failure to do so, with a base station, or the dropping of a battery charge or battery voltage below a threshold.

It has been shown to be particularly advantageous that the signalling device comprises a first communication stage, which is designed for radio-based or light-based communication according to a time slot communication protocol or for line-bound communication, and is designed for detecting a signalling command in such communications as a trigger for signalling. With this implementation, generating the light signal can be controlled remotely by means of a central system component (inventory management system server) of a system for controlling a variety of such display devices, in particular electronic price displays.

For example, the time slot communication protocol uses m time slots, e.g. 255 time slots, within n seconds, e.g. 15 seconds. The n seconds form a time slot cycle. Thus, m time slots are available within a time slot cycle for communicating with the display devices in this time slot communication method. Each of the display devices may be associated with one of the time slots, wherein several display devices may also be associated with a particular time slot.

As mentioned above, such a display device may have an energy storage device for its energy supply, such as a battery or a solar panel coupled with a rechargeable battery. In order to work as energy-efficiently as possible, it has different operating states. Its energy consumption is relatively high in an active state. The active state is present, e.g., when sending or receiving data, and during screen updates, battery voltage measurements, etc. On the other hand, the energy consumption is relatively low in a sleep state. In the sleep state, as many electronic components as possible preferably are disconnected from the power supply or switched off or at least operated in a mode with the lowest possible energy requirements. The active state is mainly present in the time slot intended for the display device to communicate with a base station. In the active state, the display device, for example, is ready to receive commands—such as the signalling command—and, if applicable, receipt data from the base station and to process the same. In the active state, send data can also be generated and communicated to the base station. Outside the time slot intended for the display device, it is mainly operated in the energy-saving sleep state. In the sleep state, it performs only those activities necessary for clocking to wake up in time, such that it is ready for the next time slot intended for it to receive a synchronization data signal and/or to communicate with the base station. In order to work energy-efficiently and thus achieve the longest possible service life, the basic operating strategy is to keep the display device, which is working in sync with the time slot communication protocol, in the sleep state for as long as possible, and to operate it in the active state for as short a period of time as possible when absolutely necessary for exchanging data with the base station.

Furthermore, it has proven to be particularly advantageous that the signalling device is designed for detecting a change in the information to be displayed by means of the screen as a trigger for signalling. For example, the transition from a first to a second item of information, which is to be displayed by means of the screen, can be a change of state serving as a trigger for the generation of the light signal. The light signal control device can be part of a display electronic unit used for controlling the screen or part of a communication stage used for receiving and processing a command to modify the information to be displayed by means of the screen. However, the light signal control device may also be provided as a separate electronic unit, which is coupled with said electronic components in order to be notified of states or state changes.

Furthermore, it has proven to be particularly advantageous that the signalling device comprises a first communication stage, which is designed for radio-based or light-based communication according to a time slot communication protocol, and that the signalling device is designed for autonomously detecting a communication problem, in particular a failure to synchronise with a base station, as a trigger for signalling. Thus, the loss of the capability to communicate with the base station can also serve as a triggering state or as a state change for generating the light signal. Herein, the light signal control device can also be part of the first communication stage, or can be coupled with it for communicating and formed separately.

The display device may also comprise a second communication stage, which is designed for contactless communication according to a communication protocol different from the time slot communication protocol. It can be designed to communicate in a capacitive and/or inductive manner. According to one preferred development, it is designed to communicate according to an RFID specification (or an RFID standard), such as ISO/IEC 10536, 14443, 15693, 10373, or VDI 4470, 4472, or ISO/IEC 18000, or EPCglobal, or ISO/IEC 15961, 15962, or any future specifications. This not only allows for reliable communication, especially over relatively short distances, such that a pairing between the display device and a communication device designed as an RFID reader (RFID reader) is ensured simply due to the necessary spatial proximity of the two devices to each other, but also the supply of electrical energy via the field used for communication (e.g. an electrostatic, magnetic, or electromagnetic dipole field). It has proven to be particularly advantageous if it is designed for communicating according to an NFC specification, such as ISO/IEC 13157, -16353, -22536, -28361 or future specifications. This has the advantage that the display device can also communicate on its own in the active NFC mode, i.e. in reader mode.

Furthermore, it is particularly advantageous that the signalling device comprises a second communication stage, which is designed for radio-based communication according to a communication protocol designed for near-field communication, in particular the standardized NFC communication protocol, and the signalling device is designed for detecting a signalling command in such communication as a trigger for signalling. Thus, processes started manually, i.e. processes started with a local device capable of NFC communication, as well as the completion of such a process, can be represented in the display device by means of the light signal. This process, for example, can be a new connection process with a base station started manually, i.e. on-site at the location of the display device, when the display device is moved into the radio range of said base station by operating personnel. As long as the new connection process is pending, a flashing light signal in the colour orange can be generated, for example. When the new connection process is completed successfully, a light signal in the form of, for example, a green flashing light can be generated, which is terminated after a certain time, e.g. a minute. The operating personnel can perceive this green flashing light incidentally from a distance and does then not need to attend to the price display in question. On the other hand, if the new connection process still is not successfully completed after a time period of 10 minutes, e.g., a light signal can be generated in the form of a continuously shining red light, for example, which does not expire on its own without further interaction with the display device. When the operating personnel perceives such a light, they must explicitly interact with the affected display device in order to eliminate the present error or problem.

As previously mentioned, instead of the first communication stage designed for radio-based or light-based communication, a first communication stage designed for line-based communication can also be used. In this case, the display device can be coupled via contacts with conductive tracks integrated in the shelf or the shelf rail, wherein various technologies, such as I2C, SPI, UART, USB etc., can be used for the execution of this design.

However, the display device according to the invention does not have to be operated exclusively as an electronic price display, as discussed previously. Rather, it can also be used advantageously as part of an emergency exit signage system, because its screen as well as the signalling device is supplied with electricity by means of an internal battery, independent of the mains. For example, in the case of automatically detected smoke, the plurality of distributed electronic price displays can be controlled accordingly via the radio network for controlling the price displays, and each of them separately can indicate the path to the nearest emergency exit. The path to the nearest emergency exit can also be indicated by means of the light signal in the coordinated interaction of individual price displays attached at different locations, if necessary, also in combination with the information displayed on the screen.

Similarly, the ESLs can also be used as part of a general guidance system for indicating a path.

It should also be mentioned that the light guide can be multi-layered. Light sources with differently coloured light can be used to inject light into the respective layer. In this context, there may be a complete overlap of the layers on the one hand, or an individual, segmented overlap of two or more layers, on the other hand. Also, the injection zones for the respective light sources can be located at different positions along the periphery of the light guide. Thus, several areas can be illuminated simultaneously with different colours.

Furthermore, the respective layers can have reflective or absorbent coatings at their edges—with the exception of the injection zones.

The display device according to the invention may have a multi-coloured screen of a specific type, in which the signalling device can introduce additional colour-related aspects, or it can implement a multi-coloured display by means of the interaction between the signalling device and the screen, which, for example, can be a purely black and white screen.

These and other aspects of the invention follow from the drawings explained below.

BRIEF DESCRIPTION OF THE DRAWINGS

The invention is explained in more detail below with reference to the attached drawings on the basis of exemplary embodiments, although the invention is not limited to said embodiments. Identical components in the different figures are labelled with identical reference numbers. The drawings schematically show.

DESCRIPTION OF THE EXEMPLARY EMBODIMENTS

Figure 1:
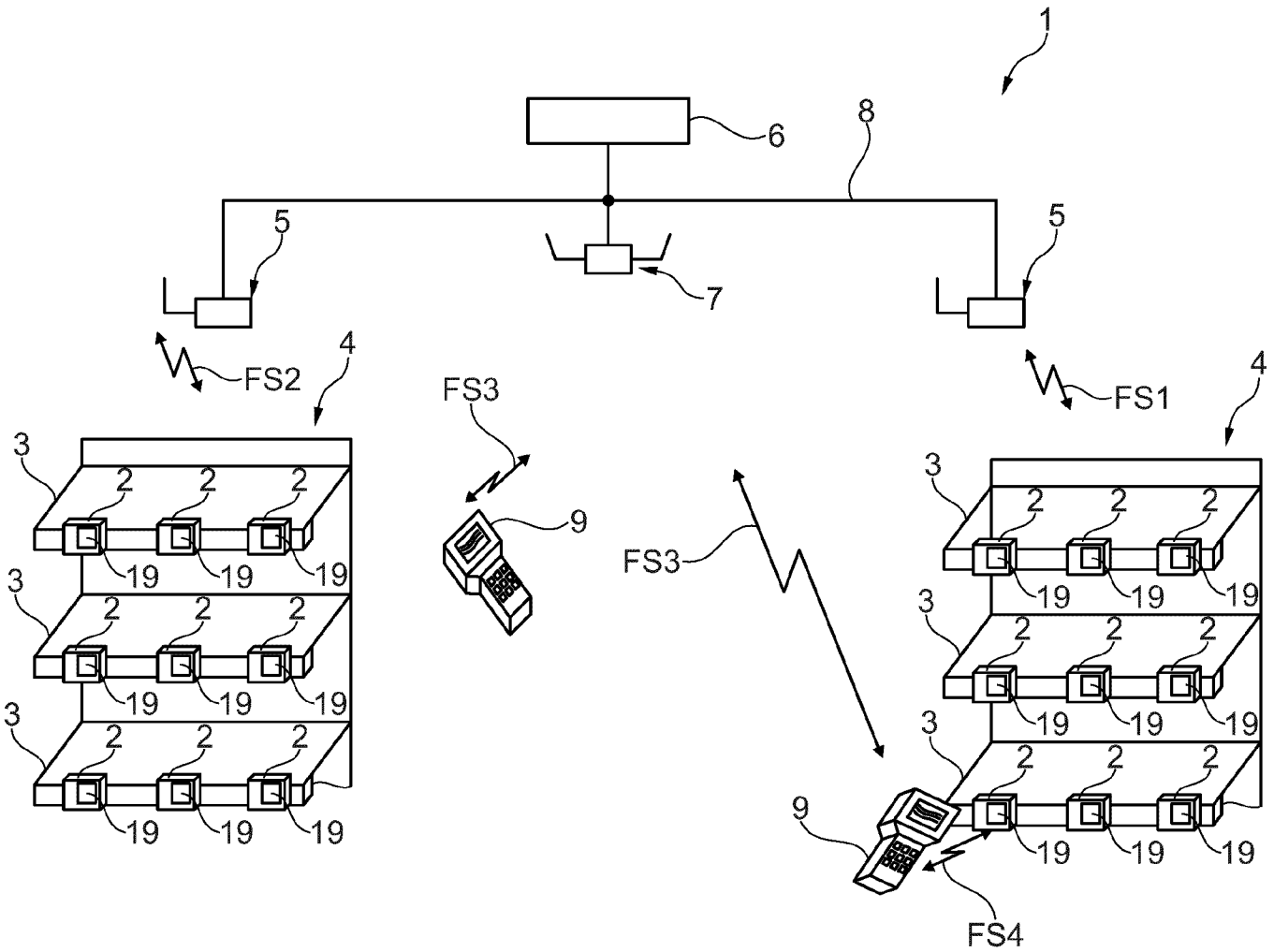
FIG. 1 An ESL system

FIG. 1 shows an ESL system installed in the premises of a supermarket, hereinafter referred to as system 1, for radio communication with electronic price displays realising the display devices according to the invention, hereinafter referred to as ESL 2. Each ESL 2 comprises a display unit 19 and is attached to shelf panels 3 of a shelf 4—specifically on a front edge of the shelf 4—corresponding to products positioned on the shelf panel 3 (not shown). The ESLs 2 comprise fasteners (not shown) with which they are attached to said front edge. At this point it should be mentioned that such ESLs 2 can also be equipped with a stand, by means of which they can be placed upright on a shelf panel. Price and/or product information related to the products is displayed using the ESLs 2. The ESLs 2 are designed for communicating according to a proprietary time slot communication protocol as well as for communicating according to the standardized NFC communication protocol.

The system 1 also comprises two base stations 5, wherein the right base station 5 wirelessly supplies the right shelf 4 with first radio signals FS1 and the left base station 5 wirelessly provides the left shelf 4 with second radio signals FS2. The separation into two radio signals FS1 and FS2 illustrates that the ESLs 2 mounted on the right shelf 4 communicate with the right base station 5 on a first radio channel, and the ESLs 2 mounted on the left shelf 4 communicate with the left base station 5 on a second radio channel. Thus, the ESLs 2 are grouped, which results from their previous registration with the respective base station. The proprietary time slot communication protocol is used for communicating with the ESLs 2. Therein, said price and/or product information is transmitted to the relevant ESL 2, for example, or status messages from the ESL 2 are received, e.g. regarding the screen update status.

It should also be noted at this point that it is not required to separate the radio ranges of the two base stations spatially, although it is shown this way in FIG. 1 for reasons of clarity. The radio ranges can also overlap (e.g. in parts of the radio range) or be coincident.

The system 1 furthermore comprises a WLAN access point, hereinafter referred to as access point 7, which covers both shelves 4 from the central location shown here. However, there may also be multiple access points 7 to provide a WLAN (wireless local area network) to the entire sales room.

The system 1 also comprises portable electronic bar code readers 9 (only two shown), which the supermarket staff can use to read bar codes attached to products or the ESLs 2 in order to associate the respective ESL 2 with the appropriate product or its place on the shelf 4 in the supermarket's inventory management system. The bar code reader 9 is WLAN-enabled and is in radio contact with the access point 7 by means of a WLAN radio protocol, which is symbolised by third radio signals FS3. The bar code reader 9 also is NFC-enabled and can communicate with an ESL 2 in its immediate vicinity by means of the NFC communication protocol (see e.g. FIG. 1 at the bottom right), which is indicated by means of fourth radio signals FS4. Herein, various actions can be triggered in the respective ESL 2, or processing states can be initiated in the ESL 2, independently of the time slot communication protocol.

The access point 7 and the two base stations 5 are connected via a wired network 8 to an inventory management system server 6 of the supermarket, which, among other tasks, in particular manages the information to be displayed by means of the ESLs 2 and screens of the respective ESLs 2.

Figure 2:
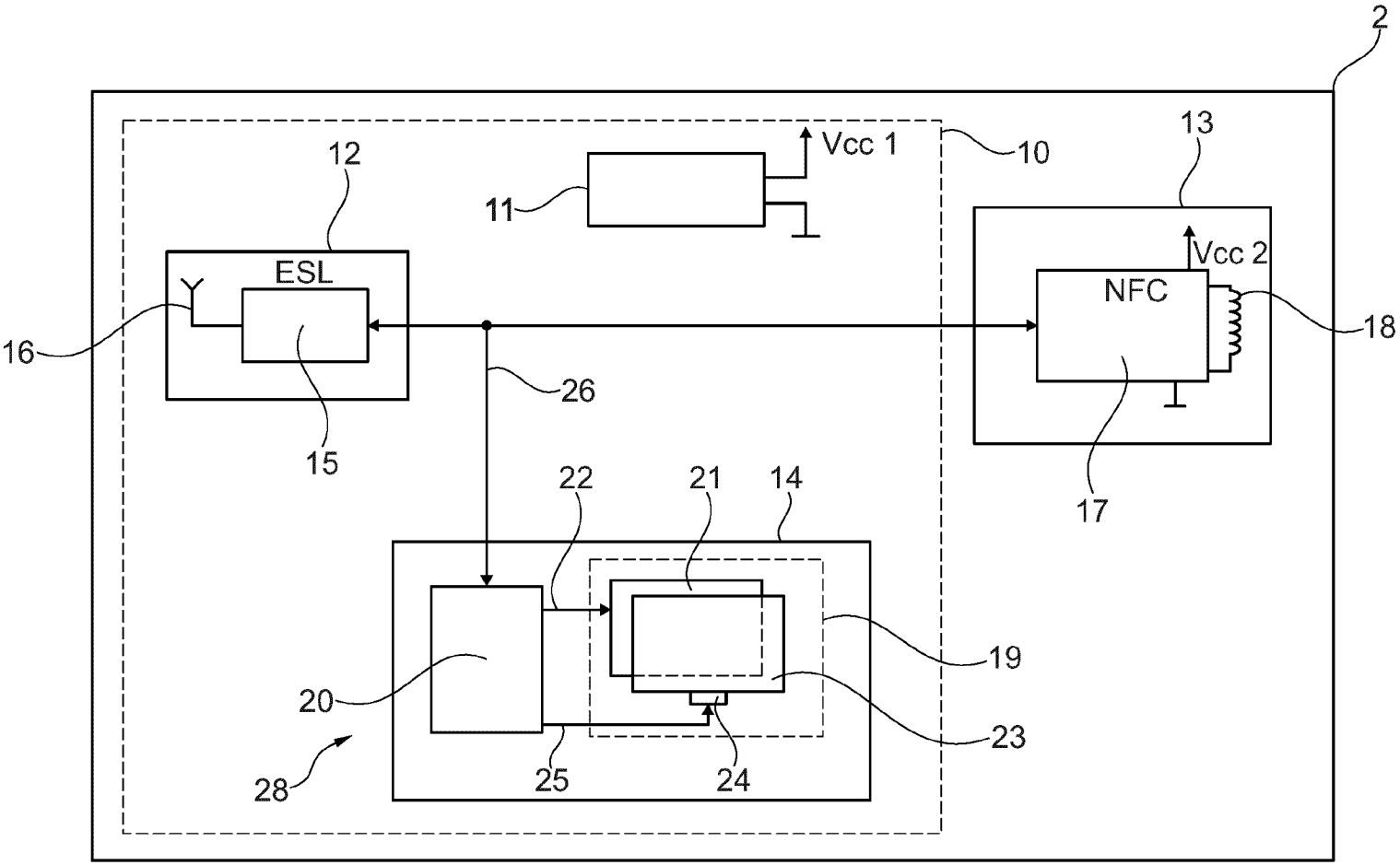
FIG. 2 A block diagram of an ESL according to the invention

The ESL 2 shown in a block diagram in FIG. 2 comprises a display module 10, which has its own power supply stage 11 in the form of a battery (not shown) for generating a first supply voltage VCC1 relative to a reference potential GND.

The display module 10 furthermore comprises a first communication stage 12, which is formed by means of a first communication electronic unit 15 coupled to an antenna 16 for communicating according to the time slot communication method.

The display module 10 furthermore comprises a second communication stage 13, which is formed by means of a second communication electronic unit 17 coupled to a coil configuration 18 for communicating inductively according to the NFC communication protocol.

The display module 10 also comprises a display stage 14, which by means of its display electronics 20 and coupled to the display unit 19 is designed for displaying said price and/or product information. The display unit 19 comprises an electrophoretic black-and-white screen 21, which is provided with first control signals 22 by the display electronics 20, in order to display the price and/or product information, for example, in a static manner and as energy-efficiently as possible.

In addition, the display stage 14 comprises a signalling device 28 for signalling operating states, i.e. general states or state changes, of the ESL 2 or the system 1. A component of this signalling device 28 is a light guide 23 applied directly on the screen 21 between a viewer (not shown) of the ESL 2 and the screen 21. The light guide 23 comprises a flat-layer design and is realised as a foil in the present case, which is glued onto the screen 21. The light guide is transparent, such that the information displayed by means of the screen 21 can be read as well and as clearly as possible. Light is injected into the light guide 23 at one of its edges by means of a light source, in this case specifically an RGB light-emitting diode arrangement 24, hereinafter referred to as RGB-LED 24. Herein, the light signal-emitting device is formed by the light guide 23 and the light-emitting diode 24.

The display electronics 20 provides the RGB LED 24 with a second control signal 25, e.g. to define the colour of the generated light or the duration of the respective light signal, the pulse duration of the light signal, the temporal intensity curve of the light signal, or the temporal colour gradient of the light signal. A light signal can be generated individually. However, a sequence of such light signals can also be generated. In this case, the control of the light signal-emitting device is executed autonomously by the display electronics 20 and in dependence on its states or state changes, which occur during the internal data processing or the controlling of the screen 21. Herein, the light signal control device is formed by the display electronics 20 alone.

A bus system 26 connects the first communication stage 15, the display stage 14 and the second communication stage 17. Thus, data that represent, e.g., commands for controlling the respective system component 12, 13, 14 or content to be processed can be transmitted, or the status of the respective system component 12, 13, 14 can be queried.

The first communication stage 12 is designed for receiving and recognizing a signalling command (as a state or state change) and for controlling the display electronics 20 via the bus system 26 as a consequence of recognizing the signalling command. Consequently, the display electronics 20 control the RGB LED 24 according to the signalling parameters transmitted by means of the signalling command, and the desired visual light signal for the viewer of the ESL 2 is emitted by means of the light guide 23. Herein, the transmission of the signalling command takes place in a communication with the base station 5 according to the time slot communication method or protocol under the control of the inventory management system server 6. The signalling command can be triggered manually by a user of the server 6 or automatically by the server 6 in response to predefined events. Herein, the light signal control device is formed by the first communication stage 12 and the display electronics 20.

Likewise, said signalling command can be received and recognised via the second communication stage 13, which represents a state or a state change, such that the display electronics 20 is controlled from there via the bus system 26. Here the transmission of the signalling command is executed during a communication according to the NFC communication protocol with an NFC-enabled device, in this case one of the NFC-enabled bar code readers 9, which is associated with the operating personnel of the supermarket. The signalling command can be triggered manually by the user of the bar code reader 9. Herein, as well, an automatic or manual triggering of the signalling command can be performed by the server 6, which communicates with the bar code reader 9 by means of the access point 7, wherein the signalling command is passed from the bar code reader 9 to the ESL 2 as soon as the bar code reader 9 is in NFC communication range with the respective ESL 2.

According to this exemplary embodiment, the display electronics 20 must be activated for each signalling activity, which contributes to the energy consumption. Herein, the light signal control device is formed by the second communication stage 13 and the display electronics 20.

In another exemplary embodiment, both the first communication electronics 15 and/or the second communication electronics 17 can be designed for directly generating the second control signal without interconnecting the display electronics 20. In this case, it is sufficient that the first or second communication electronics 15 or, respectively, 17 is active to perform the signalling. In this case, the display electronics 20 can remain completely switched off without power consumption, for example. Herein, the light signal control device is formed by the first communication stage 12 or the second communication stage 13.

However, in order to keep the operating scenarios as flexible as possible, i.e. to have a choice with regard to the timing of the electronics 15, 17 and 20 to be supplied with electricity, the exemplary embodiments described above can also be combined. In this case, it is optional whether the control signal is generated by the electronics 15, 17 or 20.

However, in the case of the generation of the second control signal 25 by the second communication electronics 17, it should be noted that the second communication electronics 17 is supplied with energy via the field during the NFC communication. However, this field is no longer available for supplying energy after the completion of the NFC communication, or at the latest after the bar code reader 9 is moved out of the NFC communication area of the respective ESL 2. This means that the signalling device 28 can only generate light signals during the period of time during which the second communication stage 13 generates a second supply voltage VCC2 relative to the reference potential GND, which enables said device to operate. In this context, the light signal can serve as an indicator for the confirmation of processes or states or state changes initiated in the ESL 2 by means of the bar code reader 9. If an additional signalling is to be initiated by means of an NFC communication, it must be communicated from the second communication stage 13 to the first communication stage 12 or the display stage 14 by means of the bus system 26, such that the display module 10 implements the signalling by means of its first supply voltage VCC1 after the second supply voltage VCC2, which is generated by the field, drops out.

Thus, the ESL 2 according to the invention, by considering internal states or state changes, allows for a dynamic and/or colour-related highlighting of said information reproduced by means of the screen 21, which results in increased attention by the viewer, thus placing the information into the centre of his perception. Additional positive effects include improved readability and better contrast for the information reproduced by means of the screen.

It should be mentioned here in general terms that internal processing situations can also be used in addition to the command recognition of the signalling command as a state or state change, as described above. For example, the server 6 can be used to initiate an update of the information reproduced by means of the screen 21. This can be used as a state or state change for signalling. Furthermore, the completion of the update can be signalled as a separate state or state change. In general, each state or change in state can be signalled individually.

Figure 3:
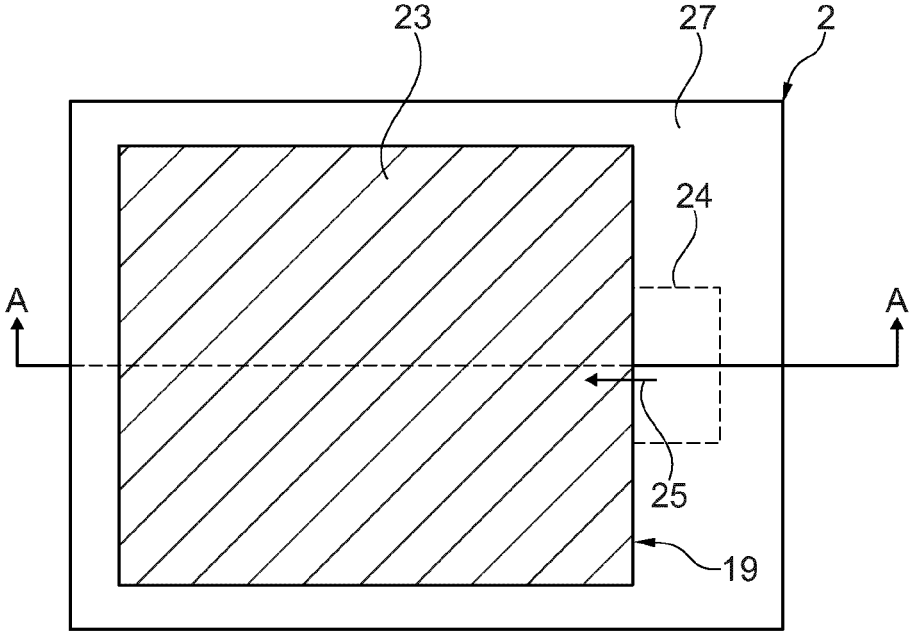
FIG. 3 An ESL in a view that shows its screen completely covered by a light guide FIG. 4 A cross-section of the ESL according to FIG. 3
Figure 4:
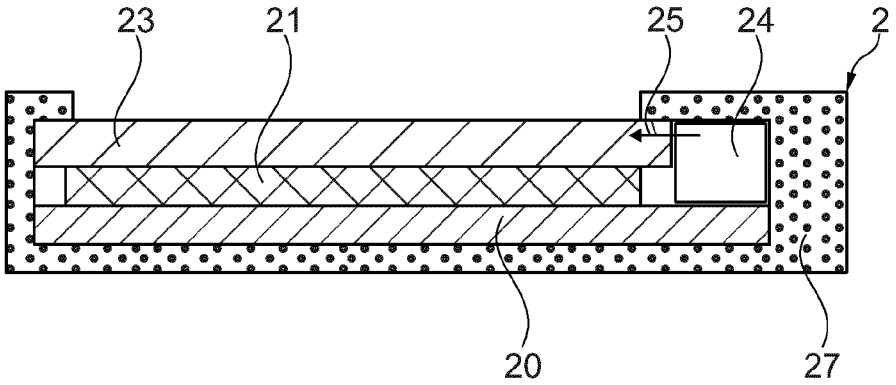

FIG. 3 and FIG. 4 show mechanical and structural details of the ESL 2.

In FIG. 3, the ESL 2 with its display unit 19 is shown facing the viewer of FIG. 3. The display unit 19 is received in a housing 27 of the ESL 2. The light guide 23 is arranged as the top or outermost component of the display unit 19, as indicated with angled hatches from top right to bottom left. However, hidden under the front part of the housing 27 to the right of the light guide 23, the RGB LED 24 is positioned as indicated schematically.

FIG. 3 also shows a line of intersection A-A, wherein the relevant sectional representation of the ESL 2 is shown in FIG. 4.

In FIG. 4, this sectional view is represented by the structure of the ESL 2. The housing 27 (shown as a dotted area in the cross-section) of the ESL 2 comprises an upward-facing recess, which allows a view of the light guide 23 and of the black-and-white screen 21, which is shown in cross-hatch, through the light guide 23. The display electronics 20 are shown with slanted hatches from top left to bottom right underneath the black-and-white screen 21. This is a printed circuit board with electronic components mounted to it (not shown in detail). The RGB LED 24 is arranged next to the light guide 23, i.e. next to the black-and-white screen 21, and is electrically connected to the display electronics 20 for receiving the second control signal 25. The injection of the light signal into the light guide 23 is executed as shown schematically with the arrow 25 from the right over the outer edge of the light guide 23.

Figure 5:
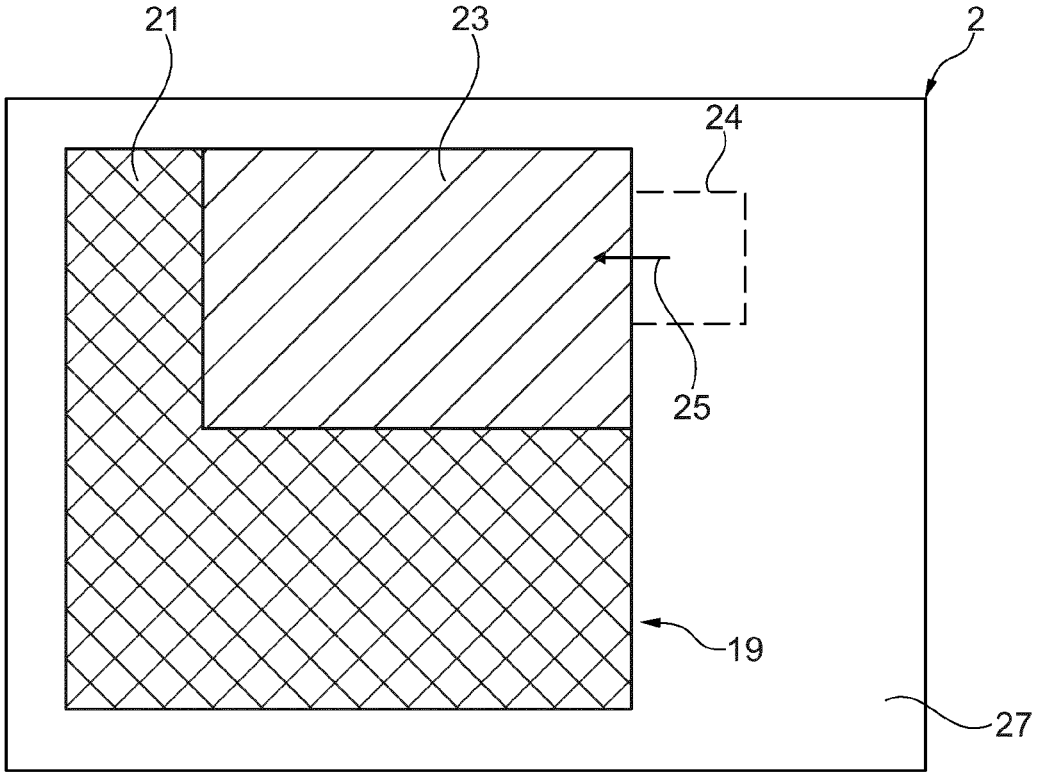
FIG. 5 An ESL in a view that shows its light guide partially covered by another light guide FIG. 6 An ESL with several light sources for injecting different light signals into a light guide arranged in front of the screen as seen in the viewing direction FIG. 7 Three ESLs mounted on a shelf and used in an emergency exit signage system FIG. 8 A timing of the light signals for the three ESLs according to FIG. 7

FIG. 5 shows an ESL 2, in which the screen 21 is only partially covered by the light guide 23. This arrangement allows for the conventional use of the screen 21 in the uncovered area, and to overlay only certain information displayed by means of the screen 21 with said light signal in the overlap area with the light guide 23.

Figure 6:
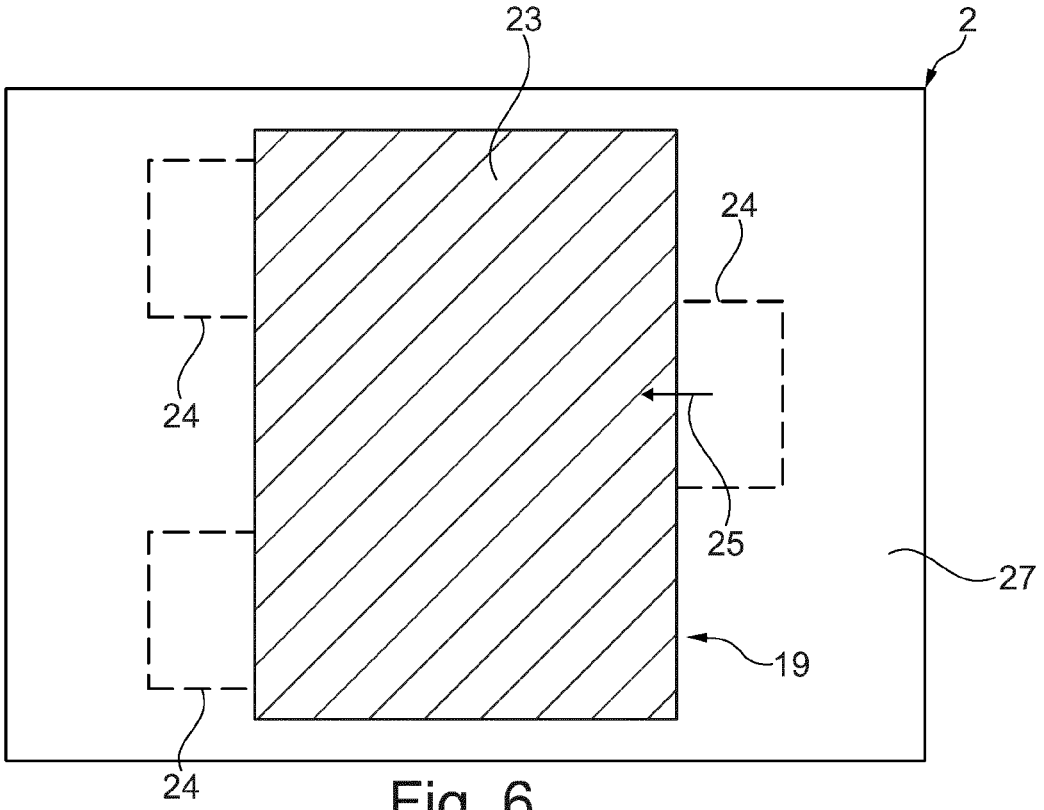

FIG. 6 shows an ESL 2, in which the whole screen 21 is covered by the light guide 23. However, in the present case, RGB LEDs 24 are installed at three different positions under the housing wall 27. These three RGB LEDs 24 are individually controlled in a manner analogous to that discussed above. They can therefore inject light signals into the light guide 23 which are independent from each other both temporally and in terms of colour, at different respective intensities, in order to generate a light signal that changes in time as well as in colour.

In the following, various operating scenarios of the ESL 2 are discussed.

Using the ESL 2, colour highlights can now be realized with the help of the black-and-white screen 21, in addition to the static black-and-white reproduction of price and/or product information, such that the viewer's attention is drawn to the respective ESL 2. For example, all of the content of screen 21 visible to the viewer can be immersed in green light to indicate that the respective products, in front of which the ESL 2 is positioned, are organic products. If the respective ESL 2 is now shifted from one shelf space to another, the illumination colour of the screen 21 can easily be adjusted to the product group positioned on the new shelf space, either via the time slot communication protocol or as part of an NFC communication. For example, the colour can be changed from green to bluish if the respective ESL 2 is positioned in front of dairy products.

Also, a change in price information that is imminent or has already taken place on the screen 21 of the ESL 2, which change was communicated to the respective ESL 2 by means of the base station using the time slot communication method as directed by the inventory management system server 6, can be dynamically highlighted by a screen flashing in a particular colour (for example, red). Therein, the duration of the flashing can be limited to a certain amount of time, for example, such that the ESL 2 automatically terminates its flashing activity after this time has elapsed. Also, the frequency of the flashing can be used to indicate the timeliness of the change. For example, a high flashing frequency can generate a high level of attention by the viewer and draw attention to those ESLs 2 on which the price has changed within the last hour or on which a price change is imminent, for example. The ESLs 2 flashing at a comparatively low frequency will attract less attention from the viewer. Such slow-flashing ESLs 2 can, for example, transmit the information to the viewer that a price was changed more than an hour before or that a special-offer phase for a product is nearing its end.

However, the ESL 2 can also be used to display internal or system-related states, which will make it much easier for the operating personnel of a supermarket, who usually receive no or little technological training, to deal with this modern technology. For example, an ESL 2 can have an asynchronous state with respect to the rigid time grid of the time slot communication method, recognize this state on its own because it does not recognize its time slot in the active state, for example, and can then indicate this asynchronous state by means of an orange light signal overlaying the black-and-white content of screen 21, for example. If the ESL 2 does not manage to establish a synchronous state in a predefined time span of, for example, five minutes and synchronize with the base station 5 with which it is associated, the colour of the light signal may be changed to red, for example. This is a signal to the operating personnel to remove the ESL 2 from the shelf 4 and to transfer it for maintenance.

However, the ESLs 2 attached to shelf panels 3 in the premises of a supermarket can also be used collectively to attract the attention of a customer. For example, the ESL system 1 can be connected to a smoke detector system that triggers a fire alarm when smoke is detected. A smoke detection can be communicated from the smoke detector system via the base stations 5 to all or a selected group of ESLs 2. The addressed ESLs 2 can then, for example, all display the letters "EMERGENCY EXIT >>>" on their black-and-white screens 21, wherein the arrows pointing to the right indicate the direction to the nearest emergency exit. At the same time, the addressed ESLs 2 can illuminate their screens 21 with a warning colour, such as red. It is also possible to illuminate the screens of the affected ESLs 2 in the green colour typically used for emergency exits. This indicating of the emergency exit by integrating the ESLs 2 into the fire alarm system also is advantageous insofar as the ESLs 2 are battery-operated and can therefore continue to display the emergency exit information including adequate light signalling despite a power outage, which typically occurs in case of fire, or if the power is shut down by the fire department, i.e. independently of an external power supply. Since each ESL 2 is provided its own battery, the ESLs 2 will continue their signalling function as emergency exit indicators even after the power is switched off or after a power failure.

However, the ESLs 2 can also implement an emergency exit display as a group. For this purpose, groups of ESL 2 preferably are used which are primarily positioned at head height on the shelves, because these will be noticed at first glance by the people in the store. Another preferred group of ESLs 2 used for this purpose are those ESLs 2 positioned near the floor, as smoke and fumes first accumulate under the ceiling and then fill the room from the top down. People crawling on the ground are then guided to the emergency exit by these ESLs 2 positioned near the ground, similar to floor-level installations in airplanes.

Since the inventory management server 6 is aware of the exact position of each ESL 2 in the sales room of a supermarket, and the supermarket's smoke detector system is aware of the position of the smoke detectors in the store, it is also possible for each ESL 2 or group of ESLs 2 to display the optimal (i.e. the fastest and least dangerous) escape route away from the danger zone and toward the nearest emergency exit, specific to each situation.

Figure 7:
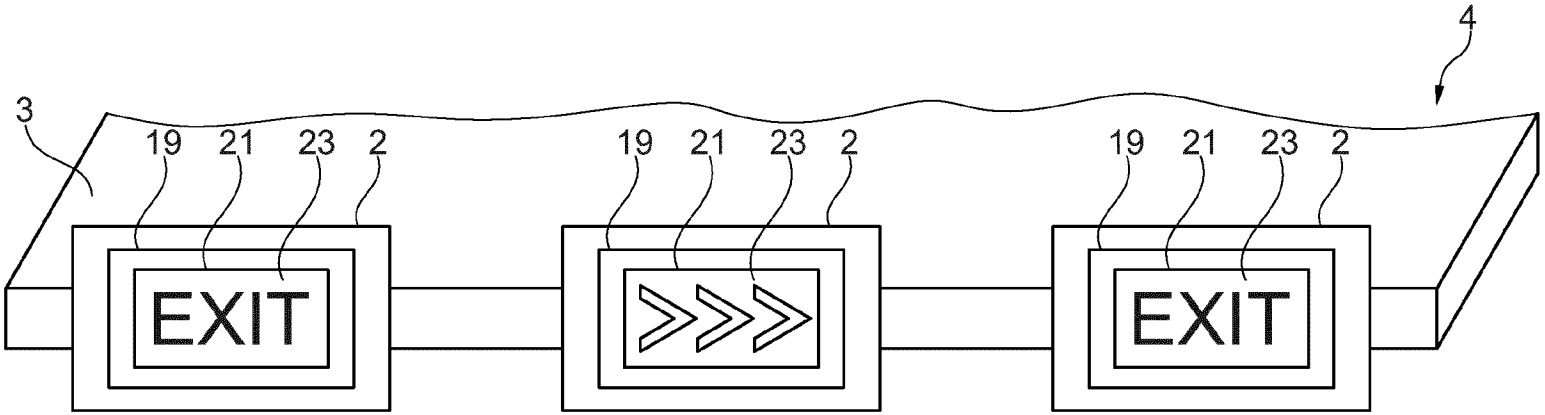

FIG. 7 visualises a grouped use of ESLs 2 as emergency exit indicators. The three ESLs 2 attached to a shelf panel 3 are programmed via the first communication stage 12 for the purpose of indicating an emergency exit in a coordinated manner. Therein, the information to be reproduced by means of the screen 21 is the text or image "EXIT" for both the left and right ESLs 2, and the text or image ">>>" for the centre ESL 2.

Figure 8:
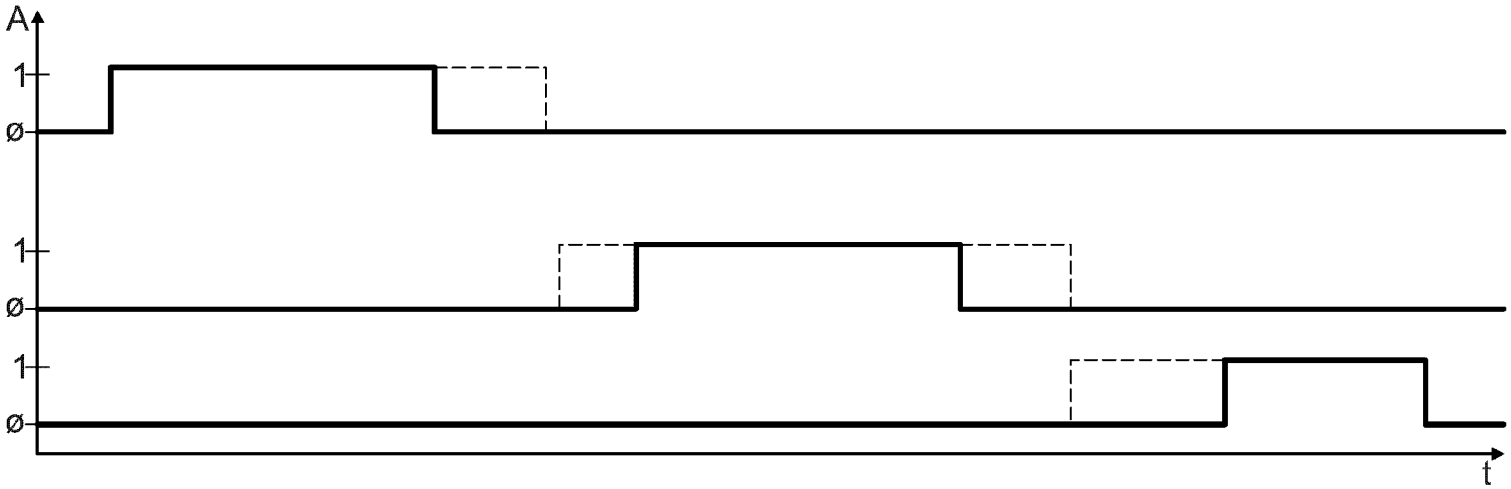

However, a coordinated timing of the signalling devices 28 of the three ESLs 2 is defined in the program, which timing is shown in FIG. 8. Therein, the activity "A" of each signalling device 28 is plotted over the time t. The top signal curve, which alternates between a switched-off state "0" and a switched-on state "1", represents the light signal which during the state "1" is emitted by the ESL 2 shown on the left in FIG. 7. The centre signal curve represents the light signal which is emitted during the state "1" by the ESL 2 shown in the centre in FIG. 7. The bottom signal curve represents the light signal which is emitted during the state "1" by the ESL 2 shown on the right in FIG. 7. The light signal emitted by means of the three ESL 2 changes its position from left to right according to the text of the centre ESL 2 ">>>" and directly indicates which direction a person must take toward the emergency exit. This means that the person no longer has to comprehend the cognitively perceptible text displayed on the screen 21 in order to find the emergency exit. As shown with a dashed line in the signal sequences in FIG. 8, the switched-on state "1" can also be maintained for such a length of time that there are no dark phases between the light signals emitted by the respective ESLs 2.

In closing, it must be noted again that the drawings previously described in detail only show exemplary embodiments, which can be modified by a person skilled in the arts in various ways without going beyond the scope of the invention. For the sake of completeness, it is also noted that the use of the indeterminate article "a" does not preclude the fact that the characteristics in question may also be present multiple times.

The invention claimed is:

1. An electronic price and/or product display device (2), which comprises:

a reflective screen (21) for displaying information;

a signalling device (28) for signalling an internal state or an internal state change of the display device (2) by superimposing said state or state change in a visually perceptible manner in the direct view of the screen; and wherein the signalling device (28) overlays only a portion of the information displayed by means of the screen with said light signal.

2. The display device (2) according to claim 1, wherein the signalling device (28) comprises a light guide (23), which is attached or oriented with respect to the screen such that its predominant light dispersion direction extends parallel to the viewing area of the screen (21).

3. The display device (2) according to claim 2, wherein the light guide (23) forms a component of the screen (21), covering the external viewing area of the screen, or is integrated into it, or forms said external viewing area.

4. The display device (2) according to claim 1, wherein the signalling device (28) comprises one or more light sources (24), in particular LED or OLED, particularly RGB LED.

5. The display device (2) according to claim 1, wherein the light source (24) is housed inside the housing of the display device (2), wherein the light generated with it is predominantly or substantially emitted or guided parallel to the viewing area of the screen or in a direction toward the viewing area.

6. The display device (2) according to claim 4, wherein the signalling device (28) comprises a light guide (23), which is attached or oriented with respect to the screen such that its predominant light dispersion direction extends parallel to the viewing area of the screen (21) and wherein the light source (24) is optically coupled with the light guide (23) for the purpose of injecting the light generated by said light source.

7. The display device (2) according to claim 1, wherein the signalling device (28) is designed for detecting a state or a state change as a result of a radio-based or light-based or line-based communication with an external device.

8. The display device (2) according to claim 7, wherein the signalling device (28) comprises a first communication stage (12), which is designed for radio-based or light-based communication according to a time slot communication protocol or for line-bound communication, and is designed for detecting a signalling command in such communications as a trigger for signalling.

9. The display device (2) according to claim 7, wherein the signalling device (28) is designed for detecting a change in the information to be displayed by means of the screen as a trigger for signalling.

10. The display device (2) according to claim 7, wherein the signalling device (28) comprises a first communication stage (12), which is designed for radio-based or light-based communication according to a time slot communication protocol, and that the signalling device (28) is designed for autonomously detecting a communication problem, in particular a failure to synchronise with a base station (5), as a trigger for signalling.

11. The display device (2) according to claim 7, wherein the signalling device (28) comprises a second communication stage (13), which is designed for radio-based communication according to a communication protocol designed for near-field communication, in particular the standardized NFC communication protocol, and the signalling device (28) is designed for detecting a signalling command in such communication as a trigger for signalling.

12. The display device (2) according to claim 1, wherein the signalling device (28) comprises a light signal-emitting device (23, 24), which generates a visually perceptible light signal for signalling, and a light signal control device (12; 13; 20; 12, 20; 13, 20) coupled or interacting with the light signal-emitting device and controlling the same, which controls the emitting of the light signal in dependence on said state or state change.

13. The display device (2) according to claim 1, said device comprises an internal power supply, in particular realised by means of a rechargeable battery or a battery, or contacts for contacting a wired external power supply.

14. The display device (2) according to claim 1, wherein the screen (21) alone or the screen together with the signalling device (28) realises a multi-coloured display.

15. The use of the display device (2) according to claim 1 as part of a path-signage system for indicating a path, or an emergency exit signage system for displaying a path to an emergency exit.

16. An electronic price and/or product display device (2), which comprises:

a reflective screen (21) for displacing information;

a signalling device (28) for signalling an internal state or an internal state change of the display device (2) by superimposing said state or state change in a visually perceptible manner in the direct view of the screen; and wherein the signalling device (28) overlays the information reproduced by means of the screen with different light signals in specific zones.

17. An electronic rice and/or product display device (2) which comprises:

a reflective screen (21) for displaying information;

a signalling device (28) for signalling an internal state or an internal state change of the display device (2) by superimposing said state or state change in a visually perceptible manner in the direct view of the screen; and wherein the signalling device (28) completely overlays the information reproduced by means of the screen with said light signal, in particular overlaying the entire display area of the screen.

* * * * *